US005103791A

United States Patent [19]

Tomisawa

[11] Patent Number: 5,103,791

[45] Date of Patent: Apr. 14, 1992

[54] FUEL SUPPLY CONTROL SYSTEM FOR INTERNAL COMBUSTION ENGINE WITH FEATURE OF EXHAUST TEMPERATURE RESPONSIVE ENRICHMENT

[75] Inventor: Naoki Tomisawa, Gunma, Japan

[73] Assignee: Japan Electronic Control Systems Co., Ltd., Isezaki, Japan

[21] Appl. No.: 690,160

[22] Filed: Apr. 24, 1991

[30] Foreign Application Priority Data

Apr. 24, 1990 [JP] Japan ..... 2-106418

[51] Int. Cl.[5] ..... F02D 41/14; F02D 41/22

[52] U.S. Cl. ..... 123/489; 123/480

[58] Field of Search ..... 123/478, 480, 489, 486

[56] References Cited

U.S. PATENT DOCUMENTS 4,319,451 3/1982 Tajima et al. ..... 123/489

4,389,994 6/1983 Denz et al. ..... 123/480

FOREIGN PATENT DOCUMENTS 62-51736 3/1987 Japan ..... 123/489

*Primary Examiner*—Andrew M. Dolinar

*Attorney, Agent, or Firm*—Foley & Lardner

[57] ABSTRACT

A fuel supply control system for an internal combustion engine sets an amount of heat generated within a combustion chamber at least based on an engine load condition, and a reference temperature of an exhaust system on the basis of an engine coolant temperature or other parameter associated with the engine coolant temperature. The control system predicts a temperature in the exhaust system based on the set head amount and set reference temperature. The control system derives a correction value for correcting a fuel supply amount on the basis of the predicted temperature of the exhaust system.

11 Claims, 6 Drawing Sheets

FUEL SUPPLY CONTROL SYSTEM FOR INTERNAL COMBUSTION ENGINE WITH FEATURE OF EXHAUST TEMPERATURE RESPONSIVE ENRICHMENT

BACKGROUND OF THE INVENTION

1. Field of the Invention

The present invention relates generally to a fuel supply control system for an internal combustion engine for an automotive vehicle. More specifically, the invention relates to a fuel supply control system, particularly applicable for the internal combustion engine with a supercharger, such as a turbocharger.

2. Description of the Background Art

In a turbocharged internal combustion engine, exhaust temperature can become excessively high at high load condition to damage exhaust valve, exhaust manifold, turbine of a turbocharger and so forth. Therefore, in the prior art, a target air/fuel ratio is set at excessively rich in a predetermined load range, such as high load range at 6000 r.p.m. or higher, in order to cool an engine combustion chamber with fuel to lower the exhaust temperature. Also, even in the steady state, the target air/fuel ratio is set so that the exhaust temperature can be maintained lower than or equal to a predetermined value.

However, since there is large heat mass in the exhaust system, the problem of rising of the exhaust temperature during steady state driving can be ignored during engine transition state, such as engine accelerating state, to high load range. In contrast, over-rich air/fuel ratio during the transition state may cause degradation of fuel economy and create associated problem of exhaust gas emission, i.e. increasing of CO emission.

SUMMARY OF THE INVENTION

Therefore, it is an object of the present invention to provide a fuel supply control system for an automotive internal combustion engine, which can effectively suppress rising of exhaust temperature and simultaneously improve exhaust emission level.

In order to accomplish aforementioned and other objects, a fuel supply control system for an internal combustion engine, according to the present invention, sets an amount of heat generated within a combustion chamber at least based on an engine load condition, and a reference temperature of an exhaust system on the basis of an engine coolant temperature or other parameter associated with the engine coolant temperature. The control system predicts a temperature in the exhaust system based on the set head amount and set reference temperature. The control system derives a correction value for correcting a fuel supply amount on the basis of the predicted temperature of the exhaust system.

According to one aspect of the invention, a fuel supply control system for an internal combustion engine comprises:

a fuel supply amount setting means for setting a fuel supply amount based on an engine driving condition;

a fuel supply means, including a driver means, for supplying a controlled amount of fuel to an induction system of the internal combustion engine;

an engine load monitoring means for monitoring a load condition on the engine;

a temperature monitoring means for monitoring a parameter associated with a temperature condition of an engine coolant;

a generated heat amount setting means for deriving and setting heat amount to be generated in a combustion chamber of the engine on the basis of at least the engine load;

a basic exhaust system temperature setting means for setting a basic exhaust system temperature on the basis of the parameter associated with the engine coolant temperature;

an exhaust system temperature predicting means for predicting an exhaust system temperature on the basis of the generated heat amount and the basic exhaust system temperature;

an exhaust system temperature dependent enrichment correction value setting means for setting an exhaust system temperature dependent enrichment correction value for lowering temperature in the exhaust system, on the basis of the predicted exhaust system temperature; and an enrichment correction means for correcting the fuel supply amount with the exhaust system temperature dependent enrichment correction value for enrichment of an air/fuel mixture ratio according to the exhaust system temperature dependent enrichment correction value.

In the preferred construction, the fuel supply control system may further comprise a delay means for providing a predetermined period of time of delay for enrichment correction when the exhaust system temperature is lower than or equal to a predetermined value.

According to another aspect of the invention, a fuel supply control system for an internal combustion engine comprises:

a fuel supply means associated with an induction system of the internal combustion engine for supplying a controlled amount of fuel thereinto;

an engine driving condition monitoring means for monitoring engine driving condition to produce various fuel supply control parameter signals which include an engine speed indicative parameter signal, an engine load indicative parameter signal, an engine coolant temperature indicative parameter signal and an air/fuel ratio parameter indicative signal;

a control unit for controlling operation of the fuel supply means so as to supply fuel at a controlled amount which is derived on the basis of the engine driving conditions represented by the parameter signals, the control unit including, first means for deriving a basic fuel supply amount on the basis of an engine speed represented by the engine speed indicative parameter signal and an engine load represented by the engine load indicative parameter signal;

second means for predicting an exhaust system temperature condition based on at least an engine coolant temperature condition, the engine speed and the engine load;

third means for deriving a correction value for enrichment correction of the basic fuel supply amount on the basis of the predicted exhaust system temperature condition for deriving a fuel supply control signal; and fourth means for feeding a fuel supply control signal to the fuel supply means for operating the latter for fuel supply in a controlled amount.

In such case, the engine driving condition monitoring means further monitors air/fuel ratio of an air/fuel mixture combustioned in an engine combustion chamber as one of fuel control parameter, and the control unit further includes fifth means for deriving an air/fuel ratio dependent correction value for further correction of the basic fuel supply amount in the fourth means. Also, the fifth means is enabled for deriving the air/fuel ratio dependent correction value only when an engine load is lower than a predetermined engine load criterion and when an engine speed is lower than a predetermined engine speed criterion.

In the preferred process, the second means derives a basic exhaust system temperature in view of the engine coolant temperature and an amount of heat to be added to the exhaust system on the basis of the engine speed and the engine load for predicting the exhaust system temperature condition.

DESCRIPTION OF THE PREFERRED EMBODIMENT

Figure 1:
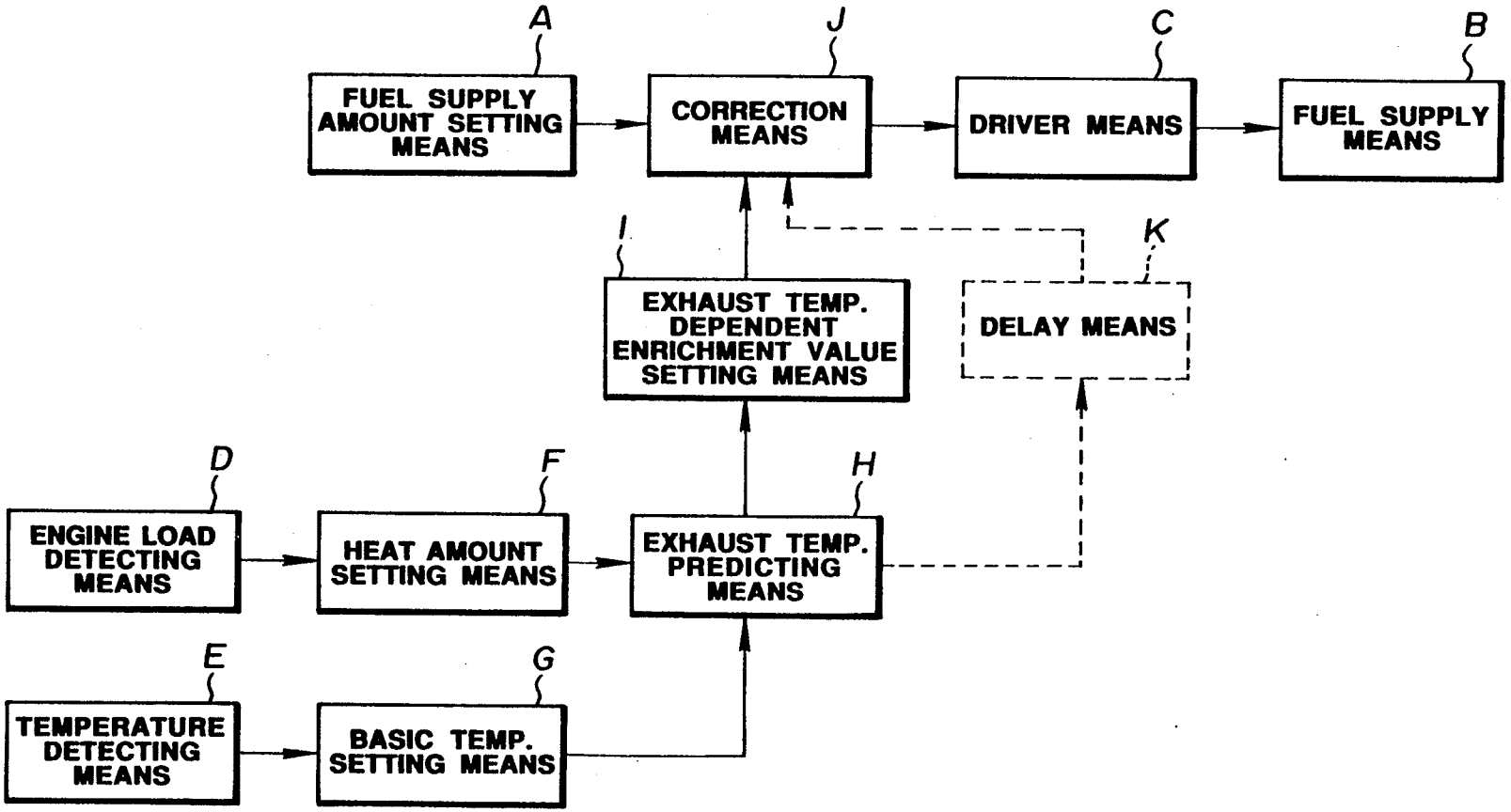
FIG. 1 is a schematic block diagram of a fuel supply control system according to the present invention, showing basic idea of the present invention.

Referring now to the drawings, particularly to FIG. 1, a fuel supply control system, according to the invention, includes a fuel supply amount setting means A which derives a fuel supply amount on the basis of an engine driving condition represented by pre-selected engine driving parameters, such as an engine revolution speed, an engine load and so forth. The fuel supply control system also includes a fuel supply means B for metering a controlled amount of fuel to an induction system of an internal combustion engine for forming an air/fuel mixture. The fuel supply means B is associated with a driver means C which drives the fuel supply means so that the controlled amount of the fuel is supplied to the induction system. The fuel supply control system includes an engine load detecting means D for monitoring load condition on the engine for providing an engine load indicative data. Also, the fuel supply control system includes a temperature detecting means B which monitors an engine coolant temperature or other parameter associated with or reflecting temperature condition of the engine coolant, for providing an engine coolant temperature indicative data. A generated heat amount setting means F receives the engine load indicative data for setting a heat amount to be generated in the combustion chamber. A basic or reference temperature setting means G receives the engine coolant temperature indicative data for setting a basic or reference temperature of an exhaust system. The generated head amount setting means F feeds the set heat amount to an exhaust system temperature predicting means H. The exhaust system temperature predicting means H also receives the set reference temperature of the exhaust system. The exhaust system temperature predicting means H predicts a temperature in the exhaust system to provide a data representative thereof. A exhaust temperature dependent enrichment value setting means I receives the predicted exhaust system temperature to derive an enrichment correction value. The enrichment correction value thus derives is fed to a correction means J which is interposed between the fuel supply amount setting means A and the driver means C so that the fuel supply amount set in the fuel supply amount setting means can be corrected with the enrichment correction value for driving a corrected fuel supply amount to be supplied to the driver means C so as to operate the latter.

It should be noted that though the shown circuit illustrates only exhaust temperature dependent correction value to be supplied to the correction means J, various correction values, such as λ-control correction value, a cold engine enrichment correction value, an acceleration enrichment correction value and so forth may be supplied to the correction means for optimization of the engine operating condition.

In addition, as illustrated by broken line, a delay means K is provided between the exhaust system temperature predicting means H and the correction means J. The delay means K is responsive to the predicted exhaust system temperature lower than a predetermined value to provide a predetermined delay for exhaust system temperature dependent enrichment.

The feature of the invention will become more clear from the further detailed discussion for the preferred embodiment of the fuel supply control system according to the invention, with reference to FIGS. 2 to 6. As can be seen the shown preferred embodiment is directed to a fuel injection control system associated with an internal combustion engine with a turbocharger.

Figure 2:
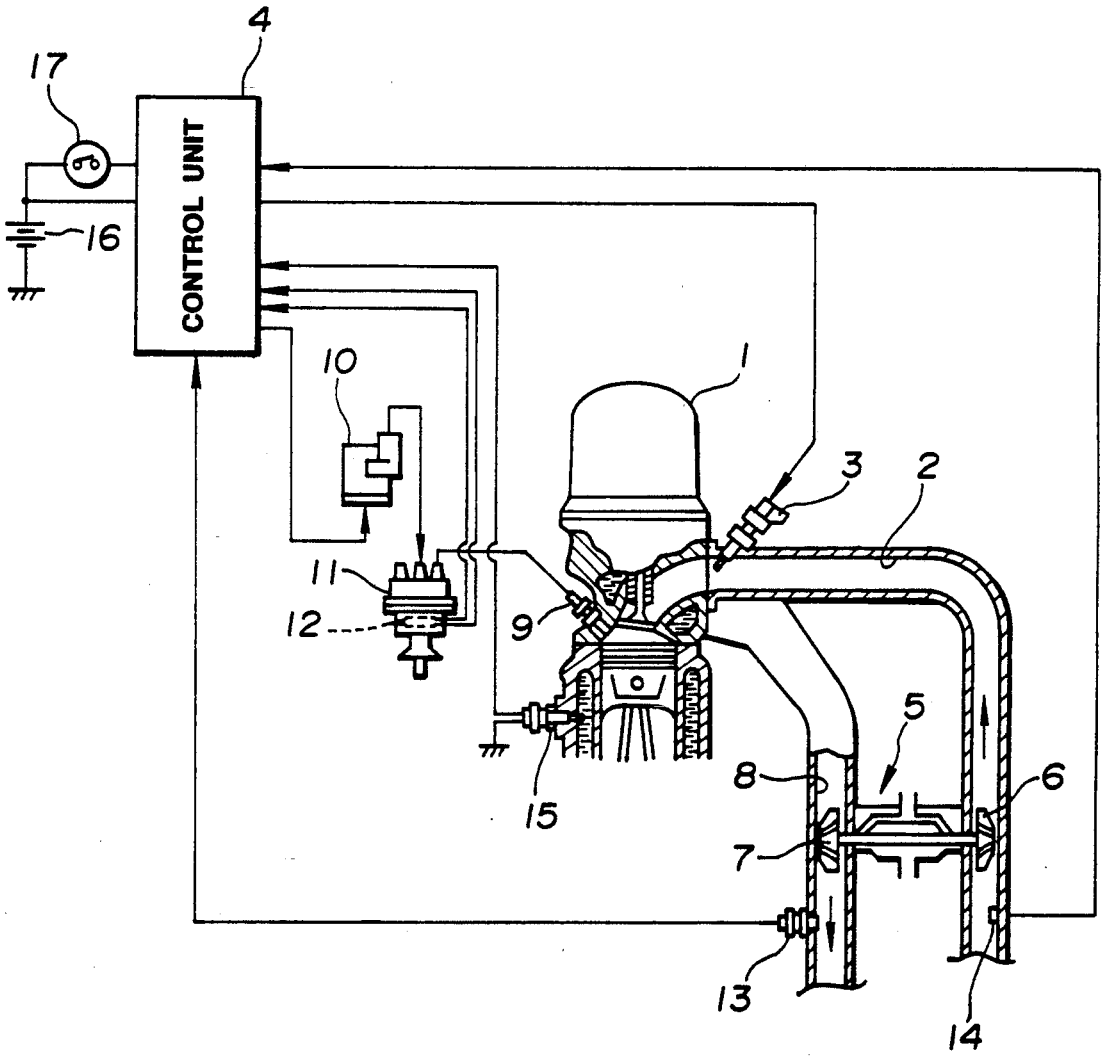
FIG. 2 is a schematic block diagram of a fuel injection control system associated with a turbocharged internal combustion engine, which implements preferred process of an exhaust temperature dependent fuel injection amount correction according to the invention.

As shown in FIG. 2, an internal combustion engine 1 includes an induction passage 2. A fuel injection valve 3 acting as the fuel supply means, is provided through the wall of the induction passage 2 in the vicinity of an intake port. As is well known, the fuel injection valve 3 is connected to a fuel pump (not shown) via a fuel delivery circuit and supplied therefrom the pressurized fuel. The fuel injection valve 3 is designed to be driven by a driver pulse which is referred to as "fuel injection pulse", from a control unit 4, to open in order to inject fuel into the induction passage for forming air/fuel mixture.

A compressor 6 of a turbocharger 5 is disposed within the induction passage 2 for boosting the intake air. The turbocharger 5 has a turbine 7 disposed within an exhaust passage 8. The turbine 7 of the turbocharger 5 is associated with the compressor 6 for co-rotation therewith. As is well known, the turbine 7 is driven by energy of exhaust gas flowing through the exhaust passage 8. The compressor 6 thus driven compresses the intake air flowing through the induction passage 2 and thus rise boost pressure of the air to be introduced into the combustion chamber.

A spark ignition plug 9 is disposed within the combustion chamber of the engine 1. The spark ignition plug 9 is connected to the control unit 4 to receive high voltage induced at an ignition coil 10 in response to a spark ignition signal from the control unit via a distributor 11. The spark ignition plug 9 thus generates spark to fire the air/fuel mixture in the combustion chamber of the engine.

The control unit 4 may comprise a microprocessor having per se well known construction. For instance, the microprocessor forming the control unit 4 may comprise CPU, ROM, RAM, A/D converter and input/output interface. The control unit 4 is connected via the input/output interface a plurality of sensors, switches and/or detectors for monitoring various engine operating parameters. The sensors, switches and detectors supply parameter signals to the control unit 4 so that the control unit may derive a fuel injection control signal for controlling fuel injection amount and fuel injection timing, and a spark ignition control signal for controlling spark ignition timing, to control operations of the fuel injection valve 3 and the spark ignition plug 9.

A crank angle sensor 12 is disposed within the distributor 11. As is well known, the crank angle sensor 12 monitors engine revolution for producing a crank reference signal at every predetermined angular position of a crankshaft, e.g. every 180° in case of 4-cylinder engine, and a crank position signal at every predetermined angular displacement, e.g. every 2°, of the crankshaft. As can be appreciated, since the crank reference signal and the crank position signal are generated in synchronism with the engine revolution, the frequency thereof reflects the engine revolution speed. Therefore, an engine speed can be derived by counting the crank position signal within a predetermined unit period or by measuring a period of the crank reference signal.

An oxygen sensor 13 is provided within the exhaust passage 8 for monitoring oxygen concentration in the exhaust gas flowing through the exhaust passage. As is well known, the output signal of the oxygen sensor signal of the oxygen sensor, which will be referred to as "oxygen concentration indicative signal", reflects rich and lean condition of the air/fuel mixture combustioned with the combustion chamber. Therefore, the oxygen concentration indicative signal serves as feedback signal for λ-control. The oxygen sensor 13 generally outputs the oxygen concentration indicative signal which is variable between HIGH level and LOW level when air/fuel ratio varies across a stoichiometric value. An air flow meter 14 is provided in the induction passage 2 for monitoring intake air flow rate as a parameter representative of the engine load condition. In addition, an engine coolant temperature sensor 15 is provided for monitoring an engine coolant temperature to produce an engine coolant temperature indicative signal.

The control unit 4 is connected to a vehicular battery 16 as a power source via an ignition switch 17. The control unit 4 receives power supply from the vehicular battery 16 while the ignition switch 17 is maintained at ON position. The control unit 4 checks the supply voltage for checking the power supply voltage as one of the engine control parameters.

The CPU of the control unit 4 performs fuel injection control operation according to the processes illustrated in FIGS. 3 to 6. Detail of respective routine will be discussed herebelow with reference to these figures.

Figure 3:
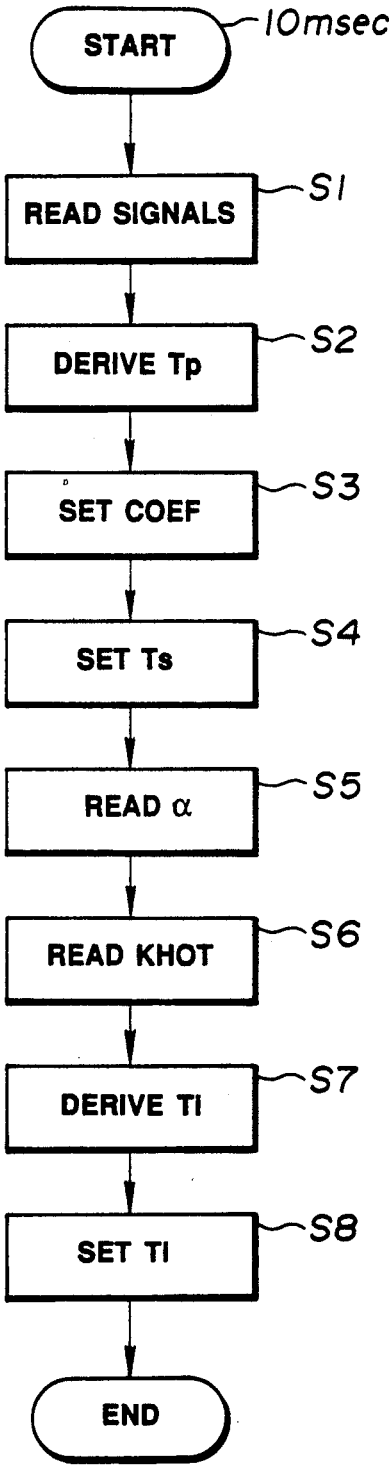
FIG. 3 is a flowchart of a routine for controlling fuel injection.

FIG. 3 shows a routine for performing fuel injection control for deriving the fuel injection amount and output the fuel injection control signal for controlling fuel injection amount and the fuel injection timing. The shown routine is cyclically or periodically executed by CPU every predetermined timing, e.g. every 10 msec. In the shown process, at a step S1, various sensor signals, switch positions and detector signals, including the crank reference signal and/or the crank position signal of the crank angle sensor 12, the oxygen concentration indicative signal of the oxygen sensor 13, the intake air flow rate indicative signal from the air flow meter 14, and so forth. At a step S2, based on the intake air flow rate Q and the engine speed N which is derived on the crank reference signal or the crank position signal, a basic fuel injection amount Tp(=KQ/N K: constant) is derived.

At a step S3, various correction coefficient, such as engine coolant temperature dependent correction coefficient for cold engine enrichment, an acceleration enrichment correction coefficient, and so forth, which may be generally represented by "COEF" and will be simply referred to as "correction coefficients" are set according to the engine driving condition. Since various methods and parameters can be taken for correction of the basic fuel injection amount and since the engine operating condition dependent correction coefficient, set forth above, are not essential to the present invention, the detailed discussion for derivation of the correction coefficients COEF is neglected. However, it should be noted any methods and parameters suitable for optimization of the fuel injection may be employed. Therefore any of corrections for the basis fuel injection amount may be taken at the step S3. For instance, the correction coefficient COEF may consist of the engine coolant temperature dependent correction coefficient, an air/fuel ratio correction coefficient, engine cranking and cold engine enrichment correction coefficient, an after idling enrichment correction coefficient, and acceleration enrichment correction coefficient. The air/fuel ratio correction coefficient is previously set in a form of a map which is to be locked up in terms of the engine speed and the engine load. The λ-control correction coefficient is set for maintaining the air/fuel ratio at stoichiometric value at normal engine driving range. On the other hand, at high load range, the map is set for over-rich mixture with maximum air/fuel ratio in excess of the stoichiometric value. At a step S4, a battery voltage dependent correction value Ts is derived depending upon the voltage level of the vehicular battery.

At a step S5, the λ-control correction coefficient $\alpha$ is read out. Subsequently, at a step S6, the system temperature dependent correction coefficient KHOT is derived for effectively cooling the exhaust gas. Thereafter, the fuel injection amount Ti can be derived at a step 7 by correcting the basic fuel injection amount according to the following equation:

$$Ti = Tp \times \mathrm{COEF} \times \alpha \times \mathrm{KHOT} + Ts$$

The fuel injection amount Ti thus derives is then set to an output register in the control unit 4 for outputting the fuel injection pulse having pulse width corresponding to the derived fuel injection amount Ti.

Figure 4:
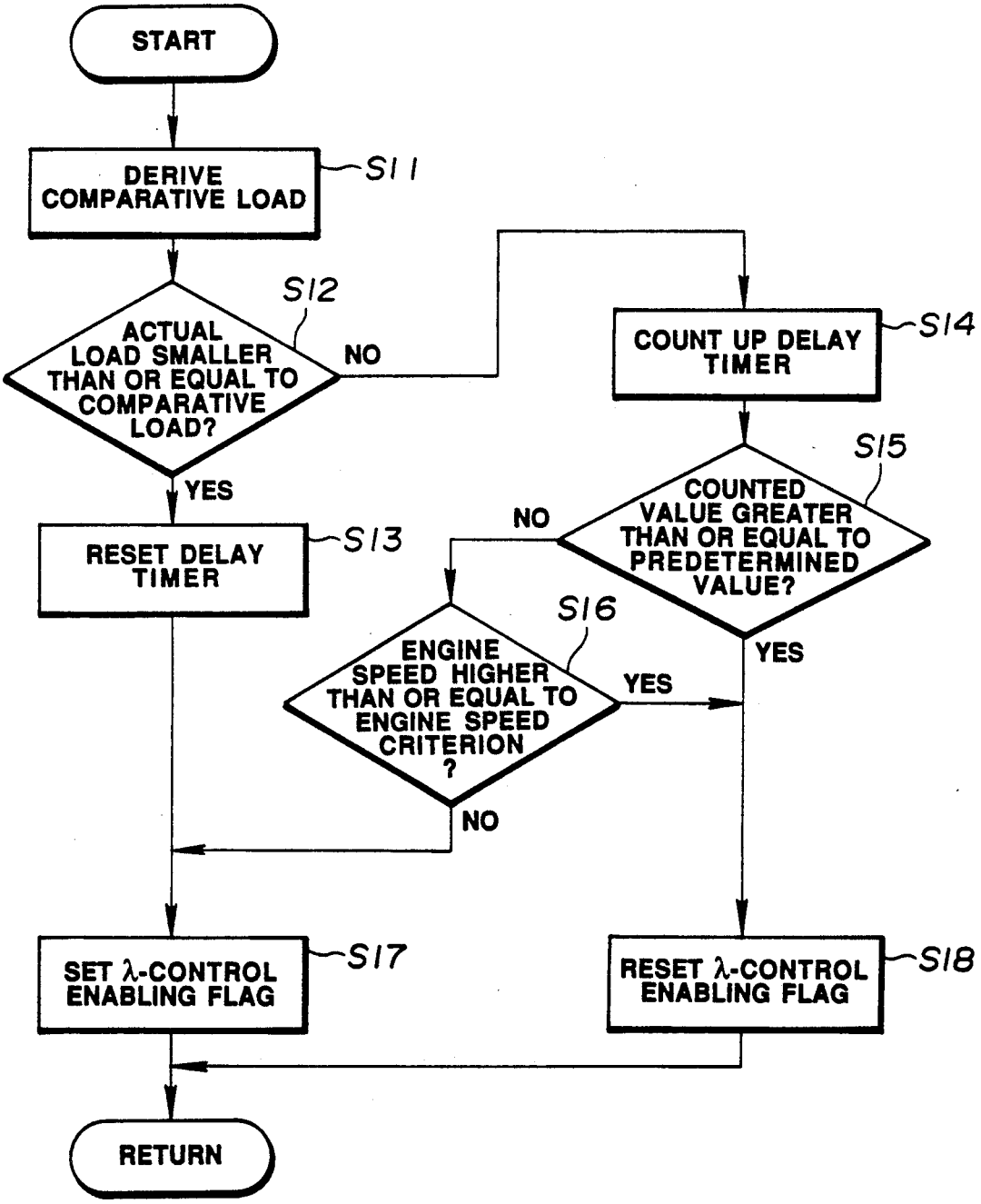
FIG. 4 is a flowchart of a routine for selectively enabling and disabling air/fuel ratio feedback control (λ-control)

FIG. 4 shows a routine for discriminating the engine driving condition for enabling and disabling λ-control for adjusting air/fuel ratio generally to the stoichiometric value. In the shown embodiment, λ-control is enabled at low or medium engine speed or low or medium load range of engine operation, which engine operational range will be hereafter referred to as "λ-control enabling range" and is disabled at high engine speed or high engine load range of engine operation, which engine operational range will be hereafter referred to as "λ-control disabling range".

At a step S11, a reference or comparative engine load (Tp) is derived from a preset map which is locked up in terms of the engine speed. This comparative engine load is set to be smaller according to increasing of the engine speed. The comparative engine load is a criterion for discrimination of the engine operational range between the λ-control enabling range and λ-control disabling range. The comparative engine load thus derived is compared with an actual engine load (Tp) at a step S12. When the answer at the step S12 is positive and thus judgement can be made that the engine is in the λ-control enabling range, process goes to a step S13 to reset a delay timer to an initial value. After resetting the delay timer at the step S13, process goes to a step S17 to set a λ-control enabling flag. On the other hand, when the answer at the step S12 is negative and thus judgement can be made that the engine is in the λ-control disabling range, process goes to a step S14 to initiate counting of the delay timer. The counted value of the delay timer is then checked whether it is greater than or equal to a predetermined value, at a step S15. When the counted value of the delay timer is greater than or equal to the predetermined value, process goes to a step S18 to reset the λ-control enabling flag and thus disables λ-control. On the other hand, when the counted value of the delay timer is smaller than the predetermined value, process goes to a step S16 to check whether the engine speed is higher than or equal to a predetermined engine speed criterion. If the engine speed is higher than or equal to the engine speed criterion, process goes to the step S18. Otherwise, process goes to the step S17.

The λ-control enabling flag thus set or reset at the steps S17 and S18 is stored in RAM.

Figure 5:
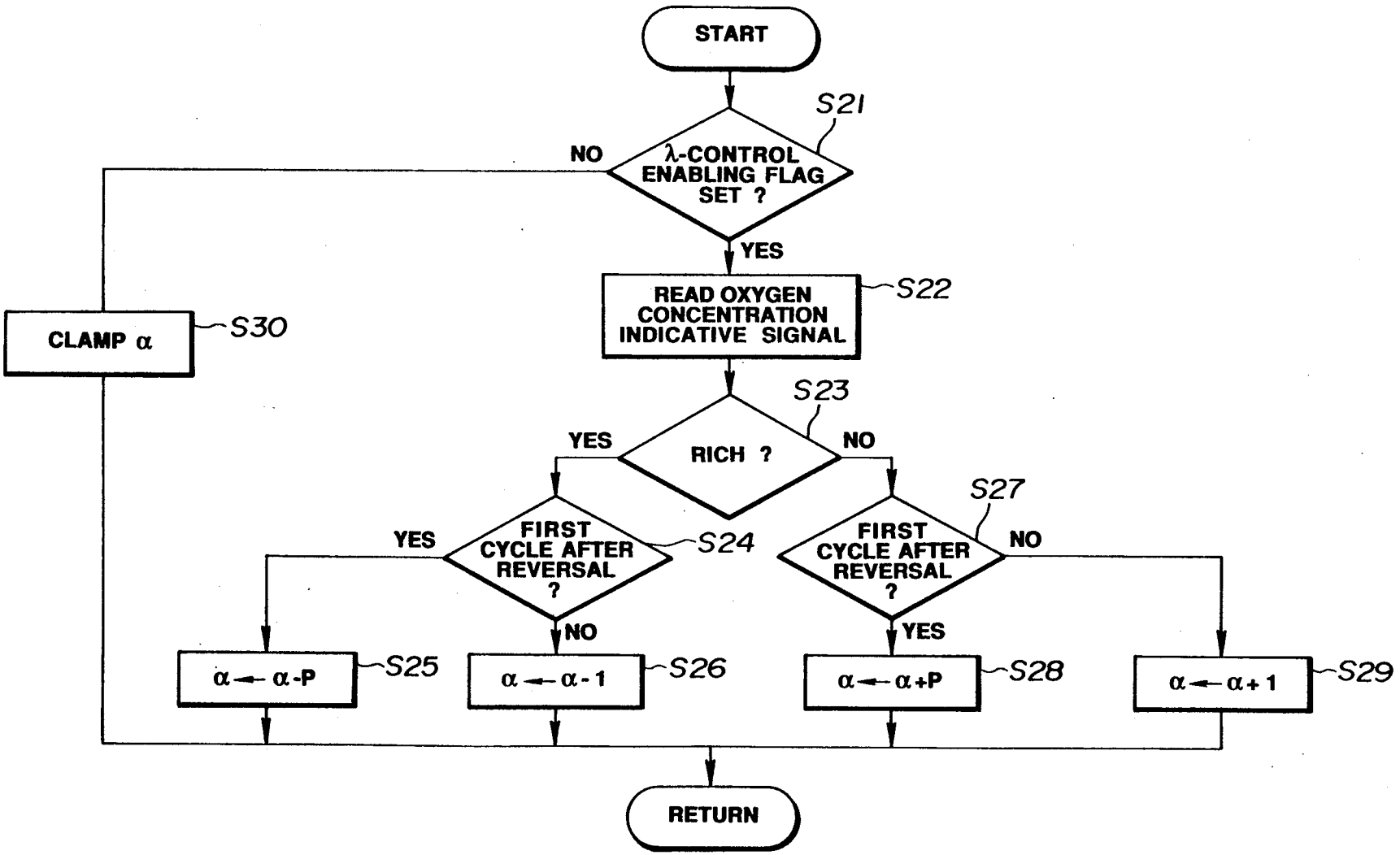
FIG. 5 is a flowchart of a routine of λ-control for correcting fuel injection amount depending upon oxygen concentration in exhaust gas.

FIG. 5 shows a flowchart showing process of setting λ-control correction coefficient α which is derived for correction of the fuel injection amount when the λ-control enabling flag is set and thus the λ-control is enabled.

At a step S21, in order to discriminate whether the λ-control is enabled or disabled, the λ-control enabling flag is checked. When the answer at the step S21 is positive and thus judgement can be made that λ-control is enabled, then, the oxygen concentration indicative sensor signal from the oxygen sensor 13 is read out at a step S22. On the other hand, if the answer at the step 21 is negative, process goes to a step S30 to clamp the λ-control correction coefficient α and then the λ-control is disabled to switch air/fuel ratio control into OPEN LOOP control.

At a step S23, the oxygen concentration indicative signal of the oxygen sensor as read out at the step S22 is checked whether it indicates rich condition or lean condition of the air/fuel mixture. When the oxygen concentration indicative signal as checked at the step S28 is HIGH level to represent the air/fuel ratio richer than the stoichiometric value, check is performed whether the current execution cycle of the instant routine is the first cycle after the oxygen concentration indicative signal level is reversed from LOW level to HIGH level, at a step S24. If so, the λ-control correction coefficient α is modified by substracting a proportional component P from the current value of the λ-control correction coefficient, at a step S25. On the other hand, when the current execution cycle is not the first cycle as checked at the step S24, the the λ-control correction coefficient α is modified by substracting an integration component I from the current value of the λ-control correction coefficient, at a step S26. On the other hand, if the oxygen concentration indicative signal as checked at the step S23 is LOW level and thus judgement can be made that the air/fuel ratio is lean, check is performed whether the current execution cycle of the instant routine is the first cycle after the oxygen concentration indicative signal level is reversed from HIGH level to LOW level, at a step S27. If so, the λ-control correction coefficient α is modified by substracting a proportional component P from the current value of the λ-control correction coefficient, at a step S28. On the other hand, when the current execution cycle is not the first cycle as checked at the step S24, the the λ-control correction coefficient α is modified by substracting an integration component I from the current value of the λ-control correction coefficient, at a step S28.

As can be appreciated, in the shown process of derivation of the λ-control correction coefficient, abrupt and substantial change of the correction coefficient is taken place immediately after reversing the air/fuel ratio between rich and lean with respect to the stoichiometric value by the proportional component P, and moderate adjustment of the correction value is taken place by the integration component subsequently. Such process is advantageously introduced for providing higher response characteristics to variation of the air/fuel ratio. Therefore, the process as shown in FIG. 5 is preferred to be employed for higher response to variation of the air/fuel ratio, and as well for higher response characteristics for lowering exhaust system temperature which is the principal of the present invention. However, since the process of air/fuel ratio control per se is not essential for the subject matter of the present invention, any other process of air/fuel ratio control may be employed for implementing the present invention.

Figure 6:
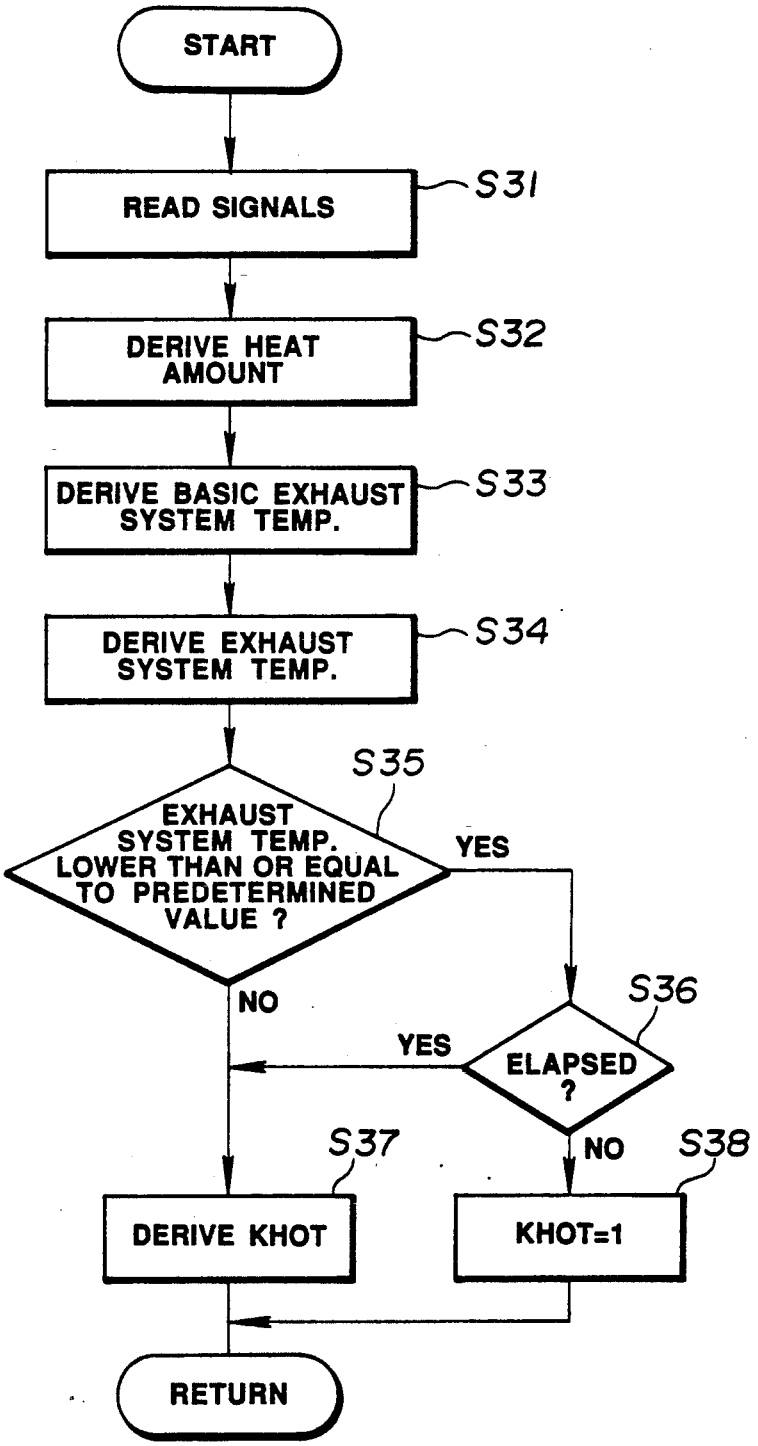
FIG. 6 is a flowchart of a routine for deriving an exhaust temperature dependent enrichment correction value.

FIG. 6 shows a routine for setting the exhaust system temperature dependent enrichment correction coefficient KHOT. At a step S31, sensor signals, switch positions and detector signals, such as an intake air flow rate indicative signal of the air flow meter 14, the engine coolant temperature indicative signal of the engine coolant temperature sensor 15 and so forth, are read out. Based on the intake air flow rate Q and the engine speed N, map look-up against a preset heat generation amount map to derive a heat amount H generated in the combustion chamber, at a step S32. The generated heat amount H increases according to increasing of the intake air flow rate, and also increases according to increasing of the engine speed.

At a step S33, a basic or reference exhaust system temperature To is derived by map look up against a basic exhaust system temperature map in terms of the engine coolant temperature. The basic exhaust system temperature To is set to be increased according to rising of the engine coolant temperature. Subsequently, at a step S34, a exhaust system temperature T is predicted through arithmetic operation utilizing the following formula:

$$T = To + (H \times K)/n$$

wherein K is a coefficient for converting the heat amount to temperature; n is a thermal capacity between the combustion chamber and the exhaust system, which thermal capacity is derived through experiments.

At a step S35, the predicted exhaust system temperature T is checked whether it is lower than or equal to a predetermined exhaust system temperature criterion. If the exhaust system temperature T is lower than the exhaust system temperature criterion and thus the answer at the step S35 is positive, process goes to a step S36 to measure an elapsed time from the first detection of the exhaust system temperature lower than or equal to the exhaust system temperature criterion. At a step 36, check is performed whether the measured elapsed time reaches a predetermined period of time.

When the measured elapsed time as checked at the step S36 does not yet reach the predetermined period of time, the exhaust system temperature dependent enrichment correction coefficient is maintained at one at a step S38. On the other hand, when the exhaust system temperature as checked at the step S35 is higher than the exhaust temperature criterion or when the measured elapsed time as checked at the step S36 reaches the predetermined period of time, process goes to a step S37. At the step S37, map look-up is performed in terms of the exhaust system temperature T for deriving the exhaust system temperature dependent enrichment correction coefficient KHOT. It should be noted that the exhaust system temperature dependent correction coefficient KHOT is set in a value greater than one and increases according to rising of the exhaust system temperature.

As can be appreciated herefrom, when the exhaust system temperature T is lower than or equal to the exhaust system temperature criterion, the exhaust system temperature dependent enrichment correction coefficient KHOT is maintained at one for a period corresponding to the predetermined period of time. This provides a delay time for enrichment of the fuel amount when the exhaust system temperature T is lower than or equal to the exhaust system temperature criterion. On the other hand, if the exhaust system temperature is higher than the exhaust system temperature criterion, enrichment correction is instantly taken place.

The present invention set forth above is advantageous in comparison with the prior art in that, since the enrichment correction coefficient is derived depending upon the exhaust system temperature, enrichment can be taken place even at steady state driving at high load range for maintaining the air/fuel ratio in over-rich condition for effectively cool the exhaust system. Therefore, the present invention can successfully prevent the engine and turbocharger from being damaged by excessive temperature in the exhaust system. On the other hand, according to the present invention, at the engine transition state including the engine operational state temporarily entering into the high load range, since the heat amount to be generated is relatively small and thus the exhaust system temperature may not be excessively high, therefore, delay time provided in the routine of FIG. 6 is effective for reducing the enrichment coefficient KHOT for reducing fuel amount to be consumed only for cooling. Therefore, this can provide higher response characteristics for acceleration demand and can improve exhaust emission level.

Therefore, the present invention fulfills all of the objects and advantages sought therefor.

What is claimed is:

1. A fuel supply control system for an internal combustion engine comprising:

a fuel supply amount setting means for setting a fuel supply amount based on an engine driving condition;

a fuel supply means, including a driver means, for supplying a controlled amount of fuel to an induction system of the internal combustion engine;

an engine load monitoring means for monitoring a load condition on the engine;

a temperature monitoring means for monitoring a parameter associated with a temperature condition of an engine coolant;

a generated heat amount setting means for deriving and setting heat amount to be generated in a combustion chamber of the engine on the basis of at least the engine load;

a basic exhaust system temperature setting means for setting a basic exhaust system temperature on the basis of the parameter associated with the engine coolant temperature;

an exhaust system temperature predicting means for predicting an exhaust system temperature on the basis of the generated heat amount and the basic exhaust system temperature;

an exhaust system temperature dependent enrichment correction value setting means for setting an exhaust system temperature dependent enrichment correction value for lowering temperature in the exhaust system, on the basis of the predicted exhaust system temperature; and an enrichment correction means for correcting the fuel supply amount with the exhaust system temperature dependent enrichment correction value for enrichment of an air/fuel mixture ratio according to the exhaust system temperature dependent enrichment correction value.

2. A fuel supply control system as set forth in claim 1, which further comprises a delay means for providing a predetermined period of time of delay for enrichment correction when the exhaust system temperature is lower than or equal to a predetermined value.

3. A fuel supply control system as set forth in claim 1 wherein said basic exhaust system temperature to be derived by said basic exhaust system temperature setting means rises according to rising of the engine coolant temperature associated parameter.

4. A fuel supply control system as set forth in claim 1 wherein said generated heat amount setting means derives the heat amount to be generated in the combustion chamber at greater value according to increasing of the engine speed.

5. A fuel supply control system as set forth in claim 1 wherein said generated heat amount setting means derives the heat amount to be generated in the combustion chamber at greater value according to increasing of the engine load.

6. A fuel supply control system as set forth in claim 1 wherein said generated heat amount setting means derives the heat amount to be generated in the combustion chamber at greater value according to increasing of at least one of the engine speed and engine load.

7. A fuel supply control system as set forth in claim 6, wherein said exhaust system temperature is predicted by the exhaust system temperature predicting means with taking a thermal capacity between said combustion chamber and an exhaust system.

8. A fuel supply control system for an internal combustion engine comprising:

a fuel supply means associated with an induction system of said internal combustion engine for supplying a controlled amount of fuel thereinto;

an engine driving condition monitoring means for monitoring engine driving condition to produce various fuel supply control parameter signals which include an engine speed indicative parameter signal, an engine load indicative parameter signal, an engine coolant temperature indicative parameter signal and an air/fuel ratio parameter indicative signal;

a control unit for controlling operation of said fuel supply means so as to supply fuel at a controlled amount which is derived on the basis of the engine driving conditions represented by said parameter signals, said control unit including, first means for deriving a basic fuel supply amount on the basis of an engine speed represented by said engine speed indicative parameter signal and an engine load represented by said engine load indicative parameter signal;

second means for predicting an exhaust system temperature condition based on at least an engine coolant temperature condition, said engine speed and said engine load;

third means for deriving a correction value for enrichment correction of said basic fuel supply amount on the basis of said predicted exhaust system temperature condition for deriving a fuel supply control signal; and fourth means for feeding a fuel supply control signal to said fuel supply means for operating the latter for fuel supply in a controlled amount.

9. A fuel supply control system as set forth in claim 8, wherein said engine driving condition monitoring means further monitors air/fuel ratio of an air/fuel mixture combustioned in an engine combustion chamber as one of fuel control parameter, and said control unit further includes fifth means for deriving an air/fuel ratio dependent correction value for further correction of said basic fuel supply amount in said fourth means.

10. A fuel supply control system as set forth in claim 9, wherein said fifth means is enabled for deriving said air/fuel ratio dependent correction value only when an engine load is lower than a predetermined engine load criterion and when an engine speed is lower than a predetermined engine speed criterion.

11. A fuel supply control system as set forth in claim 8, wherein said second means derives a basic exhaust system temperature in view of said engine coolant temperature and an amount of heat to be added to the exhaust system on the basis of the engine speed and the engine load for predicting said exhaust system temperature condition.

* * * * *